United States Patent [19]

Gendron

[11] 4,294,400

[45] Oct. 13, 1981

[54] NON-GUSSETED EXPANSIBLE ENVELOPE

[75] Inventor: Wilfred H. Gendron, Wilbraham, Mass.

[73] Assignee: Westvaco Corporation, New York, N.Y.

[21] Appl. No.: 141,052

[22] Filed: Apr. 17, 1980

[51] Int. Cl.[3] ..... B65D 27/00; B65D 30/20; B31B 1/48; B31B 1/62

[52] U.S. Cl. ..... 229/68 R; 229/75; 493/245; 493/254; 493/267; 493/918

[58] Field of Search ..... 229/68, 61, 75

[56] References Cited

U.S. PATENT DOCUMENTS

| | | | |
|---|---|---|---|
| 3,552,640 | 1/1971 | Young | 229/68 |
| 3,860,164 | 1/1975 | Dworkin | 229/68 R |
| 3,955,749 | 5/1976 | Turkenkopf | 229/61 |

*Primary Examiner*—George T. Hall

[57] ABSTRACT

The non-gusseted, side seamed expansible envelope of the present invention comprises a back panel, front panel and closure flap prepared from a single blank of paper or the like. The side seams are formed from a first pair of flaps foldably attached to the ends of the back panel and a second pair of flaps foldably attached to the ends of the front panel. Each of the side seam flaps are applied with diagonally oriented perforated lines that are located equidistant from the score line separating the front and back panels, and the second pair of side seam flaps are also applied with longitudinally oriented perforated lines which together with the diagonally oriented perforated lines provide the expansion characteristics of the envelope.

6 Claims, 8 Drawing Figures

NON-GUSSETED EXPANSIBLE ENVELOPE

BACKGROUND OF INVENTION

Expansion type envelopes are generally constructed in one of two forms, i.e., with a single center seam or with paired side seams. Moreover, expansion type envelopes are also generally constructed with gusseted side walls which provide the expansion characteristics of the envelope. In such cases, the envelope blank requires several forward and reverse folds to form the gussets and thus is difficult to manufacture on automatic equipment.

The present invention comprises an expansion envelope of the side seam type but without gussets. Accordingly, the envelope of the present invention may be readily and easily formed either by hand or on automatic equipment. The envelope is formed by applying adhesive to one or both of the side seam flaps, the flaps are then folded inward onto the front and back panels, and the front and back panels are finally folded into overlying relation to adhere the side seam flaps together.

U.S. Pat. No. 3,552,640 discloses a typical prior art construction for an expansible gusset envelope with side flap seams. In this patent, the gusset panels must be prefolded before the side seams are formed. Meanwhile, U.S. Pat. No. 3,860,164 discloses a modified construction for a gusseted expansible envelope wherein the glue flaps may be reversely folded before seaming. And, finally, U.S. Pat. No. 3,955,749 discloses another side seam gusseted expansion envelope wherein the adhered portions of the side seams project into the envelope after it is formed and set up for use. Accordingly, it may be seen that the expansible envelope of the present invention is of a much simplified design than the conventional and modified gusset designs shown in the prior art.

SUMMARY OF INVENTION

The envelope of the present invention is in the form of an expansible, non-gusseted design that is capable of being manufactured on standard type equipment or by hand. Unlike the majority of existing expansible envelopes, the envelope of the present invention can also be produced on machinery which automatically cuts and patches a window.

The above and other beneficial objects and advantages of the present invention are obtained by providing an expansible envelope formed from a one-piece unitary blank that is cut and scored to define a closure flap, front panel and back panel. A first pair of side seam flaps are coextensive with and foldably attached to the back panel and a second pair of side seam flaps are coextensive with and foldably attached to the front panel. Each of the first and second pair of side seam flaps are applied with diagonally oriented perforated lines that are located equidistant from the score line separating the front and rear panels and which begin at the common score line separating the front and rear panels from the side seam flaps. From that point the perforated lines extend outwardly therefrom to converge toward an imaginary extension of the fold line separating the front and rear panels. In this manner, the perforated lines serve to provide a bellows type action at the bottom of the envelope when the envelope is expanded. The perforated lines may also cooperate with additional transverse scores in the front and rear panels when it is desired to provide a flat bottom for the expanded envelope. The additional transverse scores are applied parallel to the score line separating the front and rear panels and they extend between the intersection of the respective perforated lines with the side seam flap score lines. Meanwhile, the second pair of side seam flaps attached to the front panel are also applied with longitudinally oriented perforated lines for the purpose of defining the adhesive application area for the side seams and to provide a hinge connection which allows the side seam to be folded inwardly on itself when the envelope is expanded. In addition, the envelope blank may contain cutouts in the side seam flaps in the region of the diagonally oriented perforated lines to make the envelope expand more easily.

The envelope of the present invention is formed by applying adhesive to one or both of the side seam flaps so that they may become adhered together only in the region outside of the longitudinal perforated lines in the second pair of side seam flaps. The side seam flaps are then folded over and onto the inside surfaces of the front and rear panels preparatory to the final folding step when the rear panel is folded over into face-to-face relation with the front panel to adhere the side seam flaps together. In this manner, the envelope is fully formed into its flattened condition and is ready for use. When it is desired to use the envelope, the sides and bottom are expanded manually while stuffing. For this purpose, indicia is preferably applied to the non-perforated side seam flaps of the envelope to show where those flaps must be pressed to rotate the perforated side seam flaps about their lines of perforation. This action produces the box-type side wall preferred for such envelopes without the necessity of prefolding gusset flaps as required by the prior art.

Accordingly, it is an object of the present invention to provide a non-gusseted side seam expansible envelope that may be formed in a single continuous operation with only two folds and a single glue application.

Another object of this invention is to provide a non-gusseted envelope in which the side seams are closed and sealed without the necessity of prefolding gusset panels.

Yet another object of the present invention is to provide a conventional box-type side wall in a non-gusseted expansible envelope.

Other objects of the invention are to provide an envelope of the type described which is simple in construction, easily and economically produced and both highly efficient and versatile in use.

DETAILED DESCRIPTION

Figure 1:
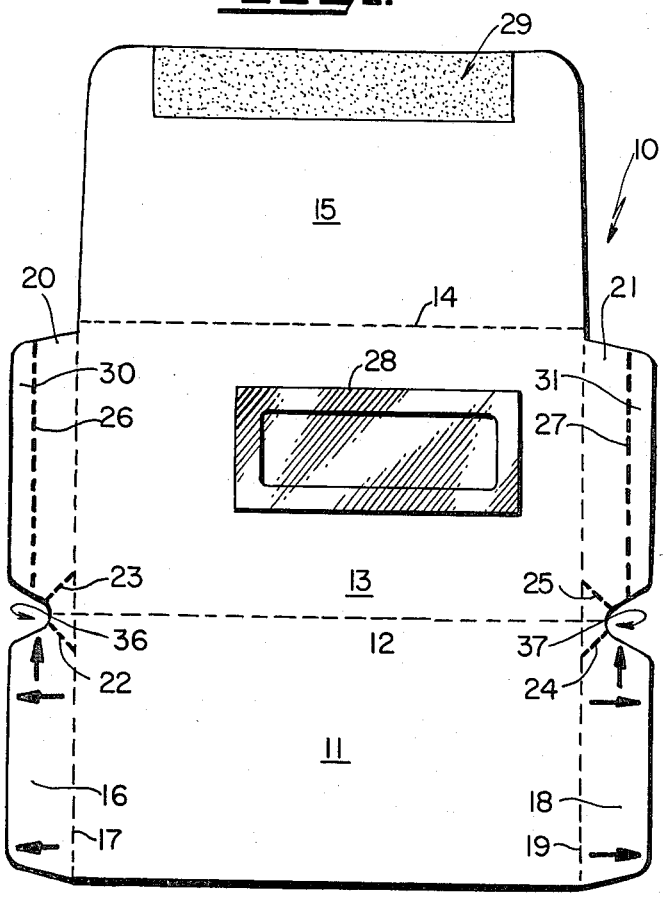
FIG. 1 is a plan view of an unfolded blank for making the non-gusseted envelope of the present invention.

Referring to the drawing in detail wherein similar components bear the same reference numerals throughout the several views, it may be seen that the present invention comprises a non-gusseted expansible envelope of relatively simple design and construction. The envelope is preferably manufactured from conventional envelope stock, but it could readily be constructed from kraft paper, paperboard or the like.

In its preferred form, the envelope is formed from a single cut and scored blank that utilizes perforated lines for ease of formation of the side seam hinges and the corners of the bottom. The blank may also contain additional score lines in the front and rear panels when it is desired to provide the envelope with a flat bottom. The blank is shaped and scored so as to enable the envelope to be formed on conventional equipment or by hand, and since the envelope does not contain any gussets, it is readily formed with a minimum of folding and gluing steps.

Referring more particularly to FIG. 1, the blank 10 comprises a rear panel 11, front panel 13 and closure flap 15 arranged longitudinally and separated from one another by transverse score lines 12 and 14. Thus, the bottom edge of the envelope is formed by score line 12 and the top edge of the envelope by score line 14. The blank 10 further includes a pair of longitudinal score lines 17 and 19 which serve as foldable connections for the side seam flaps 16,18 and 20,21. The first pair of side seam flaps 16,18 are connected to the remote free edges of rear panel 11 while the second pair of side seam flaps 20,21 are connected to the remote free edges of front panel 11. Each of the first and second pair of side seam flaps are applied with diagonally oriented perforated lines 22,23 and 24,25. These perforated lines assist in forming the bottom of the envelope when the envelope is expanded by squaring the side seam flaps. Each of the perforated lines 22,23 and 24,25 are located equidistant from the score line 12 separating the front and rear panels 13,11 and they begin at the common score lines 17,19 which separate the front and rear panels from the side seam flaps. From that point, the perforated lines extend outwardly in the side seam flaps 16,20 and 18,21 to converge toward an imaginary extension of the score line 12. The blank of FIG. 1 also includes a second set of perforated lines 26,27 arranged longitudinally in the second pair of side seam flaps 20,21. The latter perforated lines 26,27 are located so as to substantially bisect the side seam flaps 20,21 and define portions 30,31 for adhesive application. The perforated lines also provide a hinge connection for the flaps 20,21 so that the portions 30,31 may be folded back upon the respective flaps 20,21 when the envelope is squared and expanded. Finally, the envelope blank may also contain a window cutout 28 and additional V-shaped cutouts 36,37 in the side seam flaps in the region of the diagonal perforated lines 22,23 and 24,25. The cutouts 36,37 are added to reduce excess material in the region of the bottom of the envelope and to make the envelope easier to expand.

Figure 2:
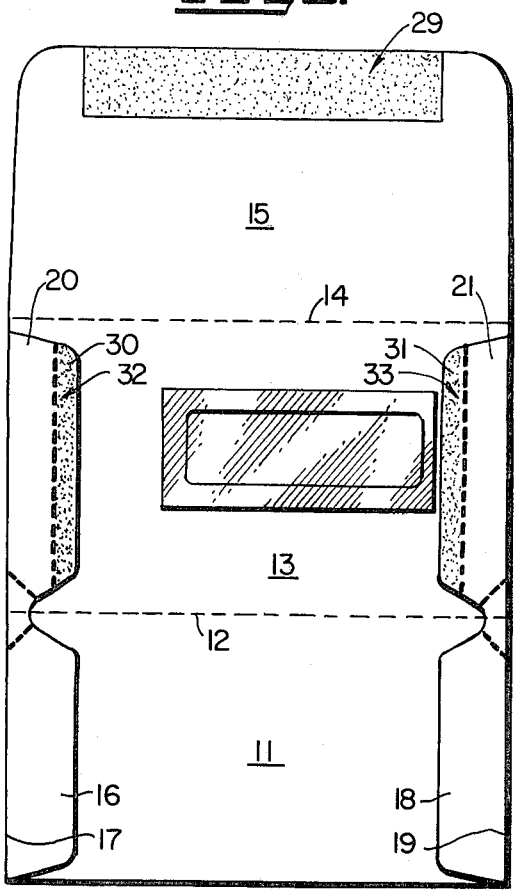
FIG. 2 is a plan view of the partially folded blank of FIG. 1.

FIG. 2 illustrates the blank 10 of FIG. 1 after the first folding step. For this purpose, the side seam flaps 16 and 20 are folded over along score line 17 and the side seam flaps 18,21 are folded over along score line 19. Adhesive is applied to the portions 30 and 31 of side seam flaps 20,21 either before or after the first folding step depending upon the type of adhesive application used. In the alternative, adhesive may be applied to the side seam flaps 18,21 or to both sets of flaps 16,20 and 18,21 if desired. In addition, a patch of adhesive 29 is also applied to the closure flap 15 which is used to seal the envelope closed.

Figure 3:
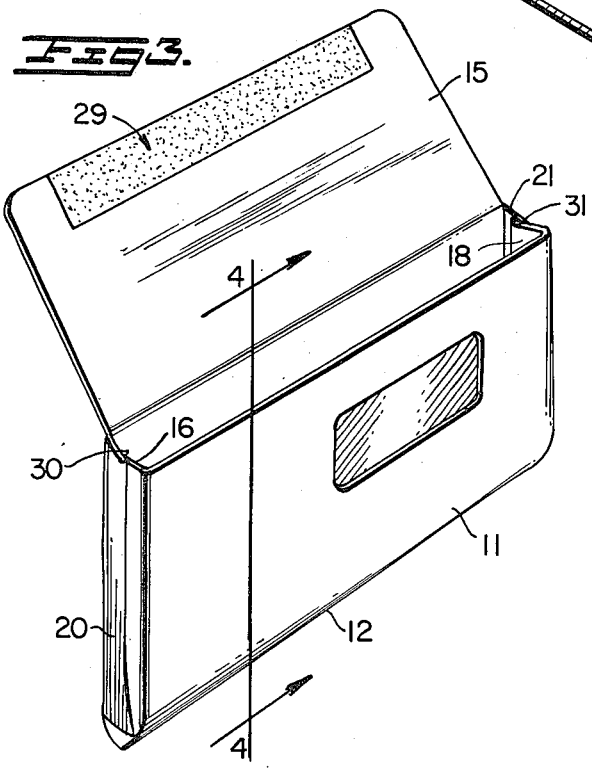
FIG. 3 is a perspective view of the folded and glued blank of FIGS. 1 and 2 showing the envelope in an expanded condition.
Figure 4:
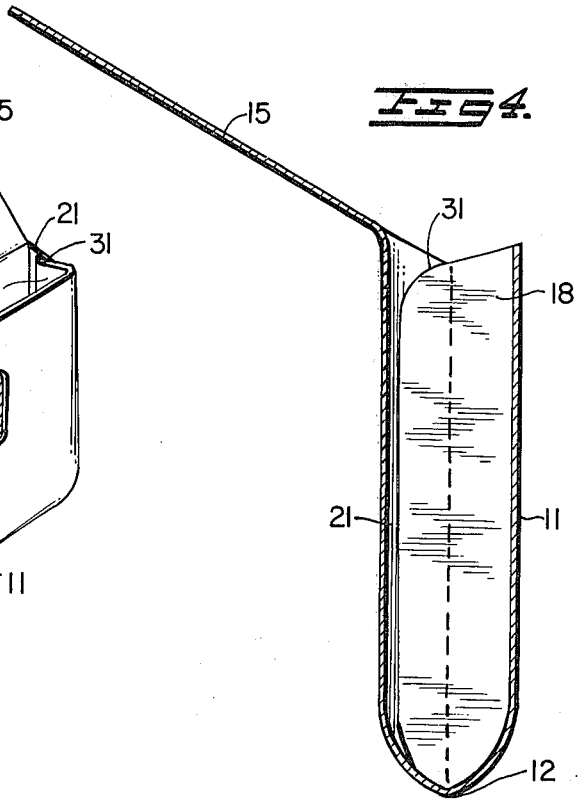
FIG. 4 is a cross-sectional view of the envelope of FIG. 3 taken along the lines 4—4.

In the second and final folding step in the formation of the envelope, the rear panel 11 is folded over about score line 12 onto the front panel 13 so as to adhere the adhesive applied areas 32,31 of side seam flaps 20,21 to the outboard edges of the side seam flaps 16,18. This folding step provides side seams that are flat without the usual gussets, but which are capable of being expanded to produce box type side walls when the hinged portions 30,31 of side seam flaps 20,21 are folded inwardly upon themselves. FIG. 3 shows the envelope in the expanded condition. For this purpose, the portions 30 and 31 of side seam flaps 20,21 are folded inwardly upon themselves with a manual application of pressure to the attached flaps 16,18. For the convenience of the user, arrows may be provided on the inside of the side seam flaps 16,18 as shown in FIG. 1 to illustrate where the manual pressure may be applied. Expansion of the envelope produces squared ends which taper inwardly toward a V-type middle section along the score line 12. FIG. 4 illustrates in cross section the squared end of the envelope formed by side seam flaps 18,21 and folded over portion 31 and the V-type middle section identified by score line 12. Such a construction is adequate for most uses. However, where it is desired to produce an envelope with a square bottom, the embodiment of the invention shown in FIGS. 5–8 may be used.

Figure 5:
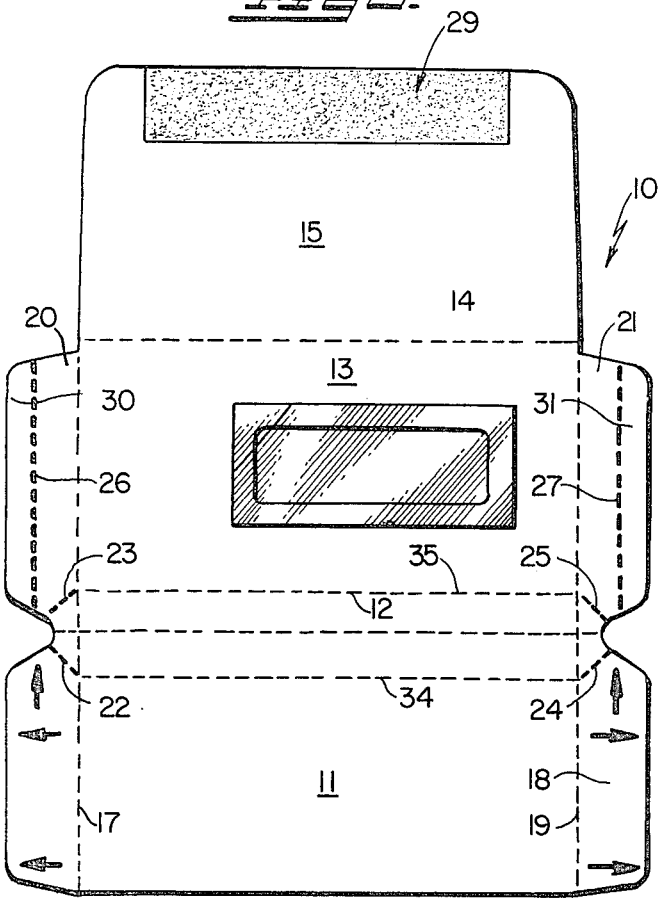
FIG. 5 is a plan view of a modified blank for making the non-gusseted envelope of the present invention.
Figure 6:
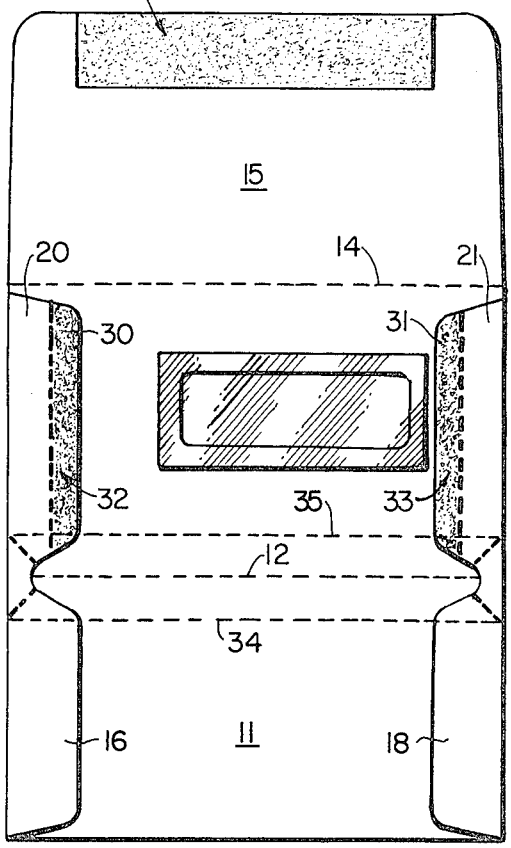
FIG. 6 is a plan view of the partially folded blank of FIG. 5.
Figure 7:
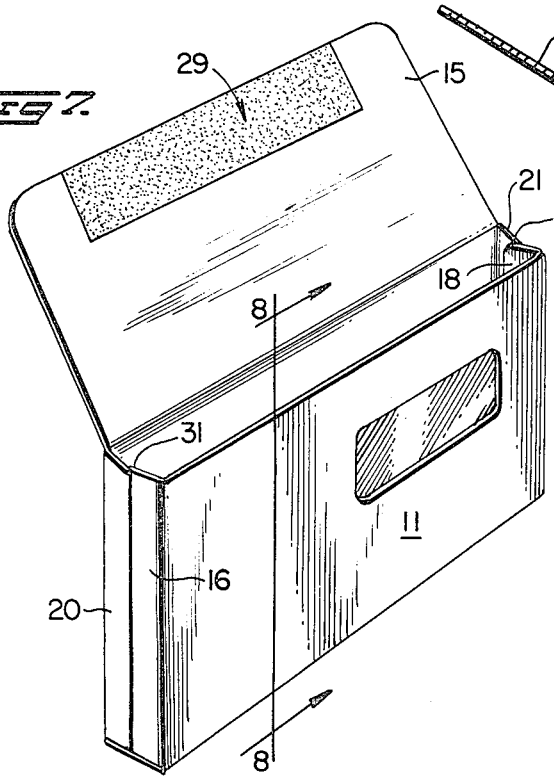
FIG. 7 is a perspective view of the folded and glued blank of FIGS. 5 and 6 showing the modified envelope in an expanded condition; and, FIG. 8 is a cross-sectional view of the envelope of FIG. 7 taken along the lines 8—8.
Figure 8:
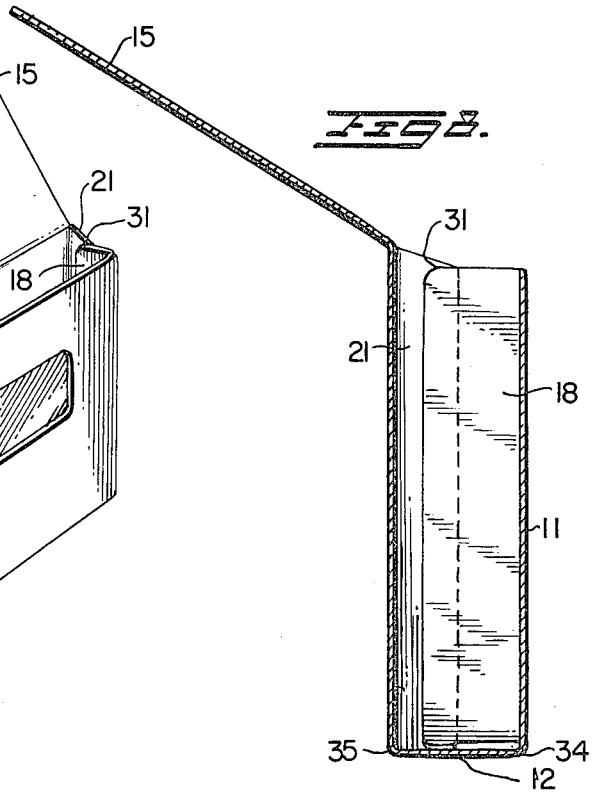

The blank shown in FIG. 5 is the same as the blank shown in FIG. 1 with the addition of a pair of transverse score lines 34,35 that are parallel to the transverse score line 12 and which extend between the beginning points of the diagonally oriented perforated lines 22,23 and 24,25. FIG. 6 is similar in all respects to the folded state of the blank in FIG. 2, and when the blank is subsequently folded to produce the final envelope, the fold is made along score line 12 to produce an envelope that in the flattened condition is similar in all respects to the envelope formed from the embodiment shown in FIGS. 1–4. However, as shown in FIGS. 7 and 8, when the envelope formed from the blank of FIG. 5 is expanded, a square bottom is produced. Note in FIG. 7 that the ends of the envelope are the same as shown in FIG. 3. Meanwhile, FIG. 8 shows the flat bottom of the envelope defined by the score lines 34,35. This embodiment of the envelope of the present invention is desirable where a great number of items are stuffed and an increased capacity is desired to prevent undue distortion of the front and rear panels.

As has previously been set forth, the significant advancements provided by the present invention lie in the configuration of the blank and in the manner in which the blank is formed to produce an expansible envelope without gussets. Thus, while only two embodiments of the present invention have been fully described and illustrated, the invention should not be so limited since other changes and additions are contemplated within the scope of the appended claims.

I claim:

1. A non-gusseted expansible envelope comprising a one piece blank including a substantially rectangular rear panel, a front panel foldably attached thereto along a transverse fold line, a closure flap foldably attached to the front panel along another transverse fold line and two pairs of equally sized and shaped side seam flaps foldably attached respectively to the side edges of the front and rear panels along a pair of longitudinal fold lines, the improvement wherein the side seam flaps attached to the side edges of the front panels are each applied with longitudinal perforated lines which substantially bisect the flaps to form outer portions for the application of adhesive and to provide hinge connections which enable the side seam flaps to be folded inwardly upon themselves when the envelope is expanded.

2. The envelope of claim 1 wherein each of the side seam flaps are applied with diagonally oriented perforated lines that are located equidistant from the score line separating the front and rear panels and which begin at the longitudinal fold lines between the front and rear panels and the side seam flaps and converge toward an imaginary extension of the score line separating the front and rear panels.

3. The envelope of claim 2 wherein each of the side seam flaps are partially cut away in the region of the diagonally perforated lines to form V-shaped cutouts at the junction between the front and rear panels.

4. The envelope of claim 3 wherein a patched window is applied to the front panel.

5. The envelope of claims 3 or 4 wherein a pair of additional score lines are applied transversely of the blank parallel to the score line separating the front and rear panels and between the beginning points of the diagonally oriented score lines.

6. A method of making and expanding a non-gusseted expansible envelope from an envelope blank having inner and outer surfaces comprising an aligned rear panel, front panel and closure flap separated from one another by transverse score lines, two pairs of equally sized and shaped side seam flaps foldably attached to the front and rear panels along spaced longitudinal score lines, a pair of longitudinally arranged perforated lines in the side seam flaps foldably attached to the front panel which form inner and outer portions thereof, and two pairs of diagonally oriented perforated lines in the side seam flaps symmetrically arranged around the score line separating the front and rear panels, comprising the steps:

(a) arranging the envelope blank with its inside surface facing upwardly;

(b) folding the side seam flaps about the spaced longitudinal fold lines to lie on the inside surface of said envelope blank;

(c) applying adhesive to the side seam flaps attached to said front panels on the outer portions thereof defined by said longitudinally arranged perforated lines;

(d) folding the rear panel over into face-to-face relation with the front panel to adhere the side seam flaps together; and, (e) expanding the envelope by manually folding the outer portions of the perforated side seam flaps inwardly upon themselves to produce a non-gusseted expansible envelope.

* * * * *